US005081498A

United States Patent [19]

Bares

[11] Patent Number: 5,081,498

[45] Date of Patent: Jan. 14, 1992

[54] HUMIDITY COMPENSATION IN ELECTROPHOTOGRAPHIC PRINTING BY MEASURING THE DIELECTRIC CHARACTERISTICS OF THE DEVELOPMENT MIXTURE

[75] Inventor: Jan Bares, Webster, N.Y.

[73] Assignee: Xerox Corporation, Stamford, Conn.

[21] Appl. No.: 639,460

[22] Filed: Jan. 10, 1991

[51] Int. Cl.[5] ..... G03G 21/00

[52] U.S. Cl. ..... 355/246; 118/689; 355/208

[58] Field of Search ..... 355/204, 208, 246, 251, 355/203; 118/688, 689

[56] References Cited

U.S. PATENT DOCUMENTS

| | | | |
|---|---|---|---|
| 3,814,516 | 6/1974 | Whited | 355/284 |
| 4,195,260 | 3/1980 | Sakamoto et al. | 355/246 X |
| 4,208,985 | 6/1980 | Anzai et al. | 118/712 |
| 4,310,238 | 1/1982 | Mochizuki | 355/246 |
| 4,395,112 | 7/1983 | Miyakawa et al. | 355/246 |
| 4,592,645 | 6/1986 | Kanai et al. | 355/206 |
| 4,660,505 | 4/1987 | Goto et al. | 118/689 |
| 4,706,032 | 11/1987 | Allen et al. | 355/203 X |
| 4,786,869 | 11/1988 | Kanai et al. | 324/207 |
| 4,888,618 | 12/1989 | Ishikawa | 355/208 |
| 4,987,453 | 1/1991 | Laukaitis | 355/246 |

*Primary Examiner*—A. T. Grimley
*Assistant Examiner*—J. E. Barlow, Jr.
*Attorney, Agent, or Firm*—H. Fleischer; J. E. Beck; R. Zibelli

[57] ABSTRACT

A developer unit which stores a supply of developer material has a capacitance cell positioned therein contacting the developer material. The capacitance cell measures the change in capacitance of the developer material and generates a signal indicative thereof. The capacitance change is caused by a change in the dielectric characteristics of the developer material due to changes in the moisture content thereof. This signal, in combination with a signal indicating the concentration of toner particles in the developer material, is used to control various processing stations in the printing machine employing the developer unit.

8 Claims, 3 Drawing Sheets

HUMIDITY COMPENSATION IN ELECTROPHOTOGRAPHIC PRINTING BY MEASURING THE DIELECTRIC CHARACTERISTICS OF THE DEVELOPMENT MIXTURE

This invention relates generally to a an electrophotographic printing machine, and more particularly concerns moisture compensation in a developer unit used in the printing machine.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer mixture into contact therewith. A common type of developer mixture comprises carrier granules having toner particles adhering triboelectrically thereto. This two-component mixture is brought into contact with the photoconductive surface. The toner particles are attracted from the carrier granules to the latent image. This forms a toner powder image on the photoconductive surface which is subsequently transferred to a copy sheet. Finally, the toner powder image and the background toner particles are heated to permanently fuse them to the copy sheet. Ideally, no background toner particles are present on the copy sheet. However, in actual practice toner particles are fused to the copy sheet in the background area.

During operation of the printing machine, toner particles are continuously depleted from the developer mixture and must be periodically replenished. Heretofore, the concentration of the toner particles in the developer mixture was controlled within a preselected bandwidth. Otherwise, if the toner particle concentration was too low, the resultant copy would be too light. Contrariwise, if the toner particle concentration within the developer mixture was too high, the resultant copy would be too dark. The overall control objective is to maintain the developability, i.e. the output density of the copy substantially constant relative to the input density of the original document. In order to achieve the foregoing, it is necessary to regulate the developability of the developer mixture within a selected bandwidth. Developability is related to the concentration of toner particles in the developer mixture as well as environmental conditions, such as temperature and humidity. As the humidity increases, the triboelectric charge of the toner particles decrease, thereby increasing the developability of the printing machine. As the humidity decreases, the triboelectric charge of the toner particles increase and the resultant developability of the printing machine decreases. It is, therefore, evident that two batches of substantially identical developer material having the same concentration of toner particles therein with one batch located in a low humidity environment, will produce a copy having a substantially lighter image than that of a copy produced by another batch of developer material located in a high humidity environment. This is particularly significant when the printing machine is initially energized. Under such circumstances, the surrounding environment has not yet stabilized and the humidity may be substantially different from that of normal operating circumstances. The change in triboelectric characteristics of the toner particles is a function of the moisture content of the toner particles. Thus, merely measuring the humidity in the surrounding printing machine environment does not necessarily provide a good measure of the change in developability characteristics of the developer material. In addition, to controlling the toner particle concentration to achieve satisfactory developability, it is frequently desirable to control other processing stations within the printing machine to optimize developability.

Various techniques have hereinbefore been used to achieve the foregoing as illustrated by the following disclosures, which may be relevant to certain aspects of the present invention:

U.S. Pat. No. 3,814,516
Patentee: Whited.
Issued: June 4, 1974.

U.S. Pat. No. 4,208,985
Patentee: Anzai et al.
Issued: June 24, 1980.

U.S. Pat. No. 4,395,112
Patentee: Miyakawa et al.
Issued: July 26, 1988.

U.S. Pat. No. 4,592,645
Patentee: Kanai et al.
Issued; June 3, 1986.

U.S. Pat. No. 4,660,505
Patentee: Goto et al.
Issued; Apr. 28, 1987.

U.S. Pat. No. 4,786,869
Patentee: Kanai et al.
Issued; Nov. 22, 1988.

U.S. Pat. No. 4,888,618
Patentee: Ishikawa.
Issued; Dec. 19, 1989.

The foregoing disclosures may be briefly summarized as follows:

U.S. Pat. No. 3,814,516 discloses a humidity compensated control device including a temperature compensated lithium chloride cell whose resistance is inversely proportional to humidity. The lithium chloride cell is connected in a wheatstone bridge arrangement to provide a voltage output indicative of humidity changes in the surrounding environment. This voltage output is used to correct the toner discharge signal for humidity changes.

U.S. Pat. No. 4,208,985 describes an apparatus for monitoring the concentration of toner in a developer mix. The apparatus has a reservoir storing the developer mix. A sampling cylinder is located in the reservoir. A detecting coil is disposed about the outer periphery of the sampling cylinder. The developer mix flows through the sampling cylinder and the inductance measured by the coil provides a measure of the toner concentration.

U.S. Pat. No. 4,395,112 discloses a developer unit in which the magnitude of the electrical bias on the developer roll is changed to a lower value when the relative humidity of the atmosphere is greater than a predetermined value.

U.S. Pat. No. 4,592,645 and U.S. Pat. No. 4,786,869 describe a toner concentration detection system including a toner level detector having a plurality of magnetic circuits. Each of the magnetic circuits have magnetic gaps and coil members wound around the circuits to yield a differential output form the magnetic circuits. A reference AC signal is provided and a phase detector compares the phases of the differential circuits and yields a DC voltage based on the results to detect toner concentration of a developer containing a magnetic carrier and a toner.

U.S. Pat. No. 4,660,505 discloses an apparatus for developing an electrostatic latent image with a two component developer. The apparatus includes a developer container, a non-magnetic mixing roller, a magnetic roll and a detecting device for sensing toner concentration. When the detecting device is positioned in one position, it is highly sensitive to changes in humidity. In another position, the detecting device is relatively insensitive to changes in relative humidity.

U.S. Pat. No. 4,888,618 describes an electrophotographic printing machine having ambience sensor including a humidity sensor and a temperature sensor positioned in the neighborhood of a toner hopper or in the neighborhood of the developing device. The absolute humidity is determined from temperature and humidity data every thirty minutes. This information is used to select the appropriate coefficient from a look up table for calculating the contrast potential. The calculated contrast potential is stored.

In accordance with one aspect of the present invention, there is provided an electrophotographic printing machine of the type having a plurality of processing stations with one of the stations being a developer station storing a supply of developer material for developing a latent image recorded on an image receiving member. The improvement includes means, in contact with the developer material in the developer station, for measuring the developer material dielectric characteristics and generating a signal indicative thereof. Means, responsive to at least the signal from the measuring means, control at least one of the processing stations in the printing machine.

Pursuant to another aspect of the present invention, there is provided a developer unit including means for storing a supply of developer material comprising at least toner particles and carrier granules. Means, positioned in the storing means and contacting the developer material therein, measure the developer material dielectric characteristics and generate a signal indicative thereof.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
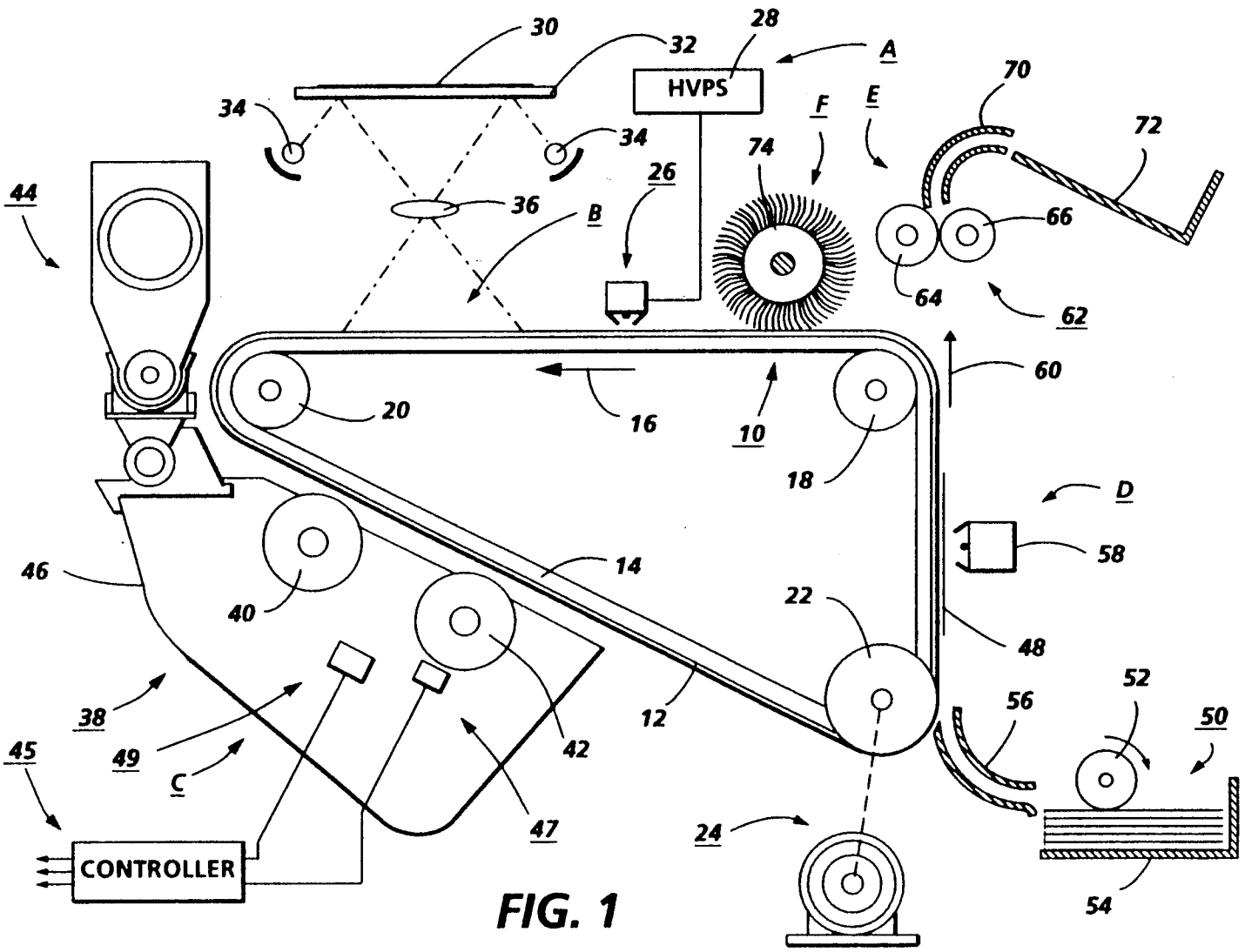
FIG. 1 is a schematic elevational view of an illustrative electrophotographic printing machine incorporating a developer unit having the features of the present invention therein.

Referring now to FIG. 1, the electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a magnetic brush development system, indicated by the reference numeral 38, advances developer material into contact with the latent image. Preferably, magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38. Toner dispenser 44 includes a container storing a supply of toner particles therein. A foam roller, disposed in a sump located beneath the container, meters toner particles into an auger. A motor rotates the auger to dispense toner particles into the developer housing. Energization of the motor is controlled by a controller, indicated generally by the reference numeral 45. A probe, indicated generally by the reference numeral 47, is connected to controller 45. Probe 47 senses the electrical current flowing through the developer material and transmits a signal to controller 45. Probe 47 is further described in U.S. Pat. No. 4,343,548 issued to Bares et al. in 1982, the relevant portions thereof being hereby incorporated into the present application. A sensor, indicated generally by the reference numeral 49, is located in the chamber of developer housing 46 contacting the developer material disposed therein. Sensor 49 detects the moisture content of the developer material and transmits a signal indicative thereof to controller 45. Controller 45 develops error signals as a function of the signal from probe 47 and sensor 49. The error signals are corrected for the moisture content of the developer material. The error signals from controller 45 may be used to regulate various processing stations within the printing machine. For example, error signals from controller 45 may be used to regulate the power supply 28 energizing corona generator 26, lamps 34, and/or the discharge of toner particles from toner dispenser 44.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image formed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. Chute 70 then advances sheet 48 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
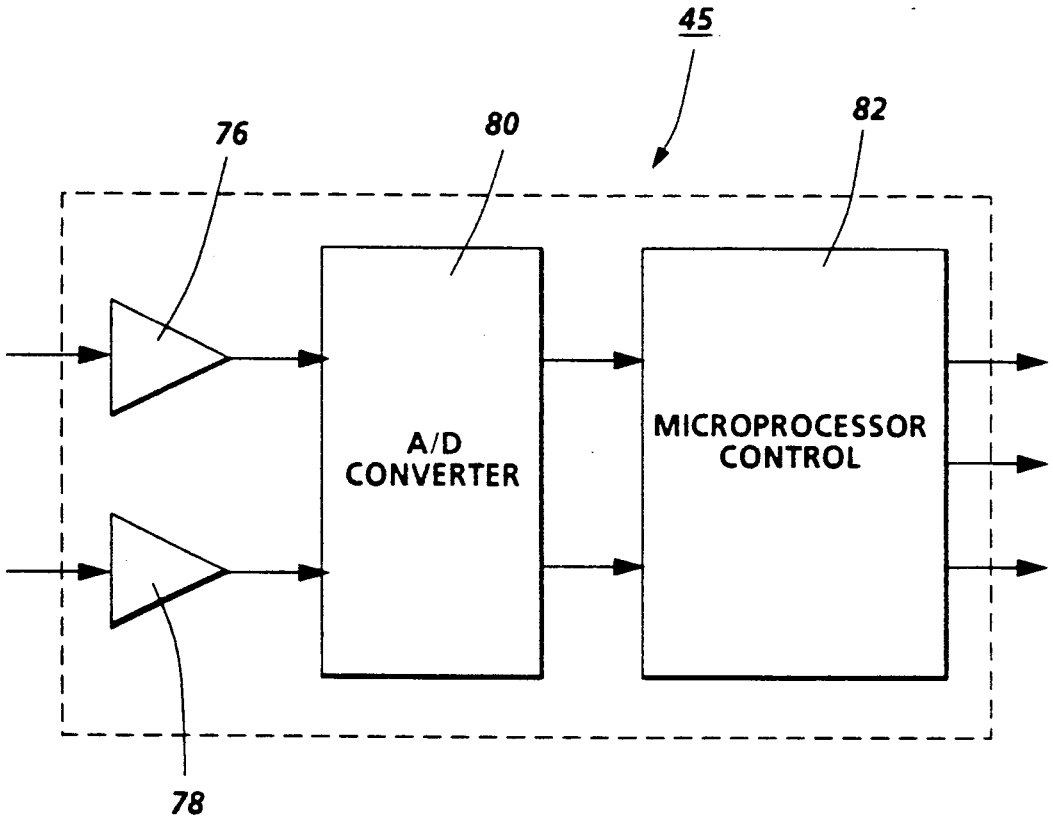
FIG. 2 is a a block diagram illustrating the control system regulating the various processing stations in the printing machine.
Figure 4:
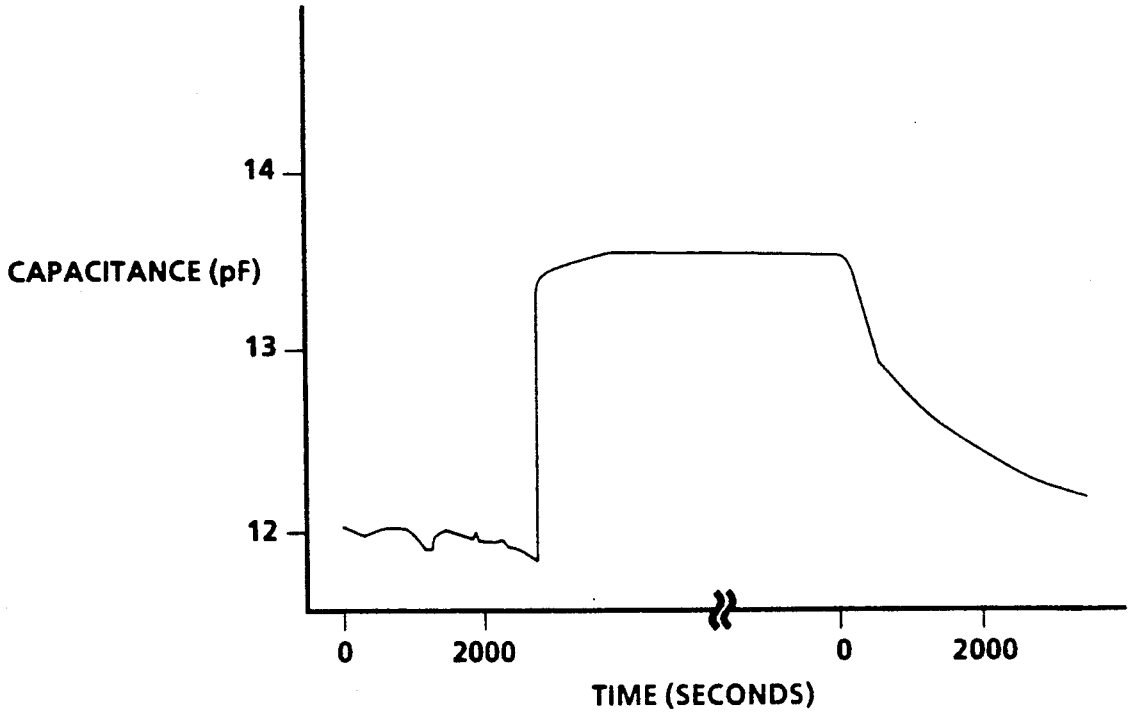
FIG. 4 is a graph showing the time response of the FIG. 3 sensor to changes in capacitance induced in the sensor by the developer material.

Referring now to FIG. 2, there is shown controller 45 in greater detail. As shown thereat, the moisture signal from sensor 49 and a suitable processing circuit (not shown) is transmitted to amplifier 76. A suitable processing circuit is one producing a signal proportional to the sensed capacitance, as shown in FIG. 4. The concentration signal from probe 47 and a suitable processing circuit (not shown) is transmitted to amplifier 78. A suitable processing circuit is one producing a signal proportional to the sensed developer conductivity. The amplified output signals from amplifiers 76 and 78 are transmitted to an analog to digital (A/D) converter 80. The digitized signals from A/D converter 80 are transmitted to microprocessor 82. Microprocessor 82 has a suitable algorithm for comparing the concentration signal with a desired reference signal and correcting the signal as a function of the moisture signal to generate error signals that have been corrected for the change in dielectrtic characteristics of the developer material due to changes in moisture content. The corrected error signals are transmitted to various processing stations within the printing machine to control the operation thereof. An error signal is used to control the motor rotating the auger of toner dispenser 44 to discharge toner particles therefrom into the chamber of developer housing 46. Another error signal may be used to regulate the electrical bias applied on developer rollers 40 and 42. Other error signals may be used to regulate high voltage power supply 28 to control corona generator 26 and to regulate the intensity of lamps 34. Thus, it is clear that microprocessor 82 may generate several error signals for regulating different processing stations in the printing machine as a function of the concentration of toner particles in the developer material and the moisture content of the developer material.

Figure 3:
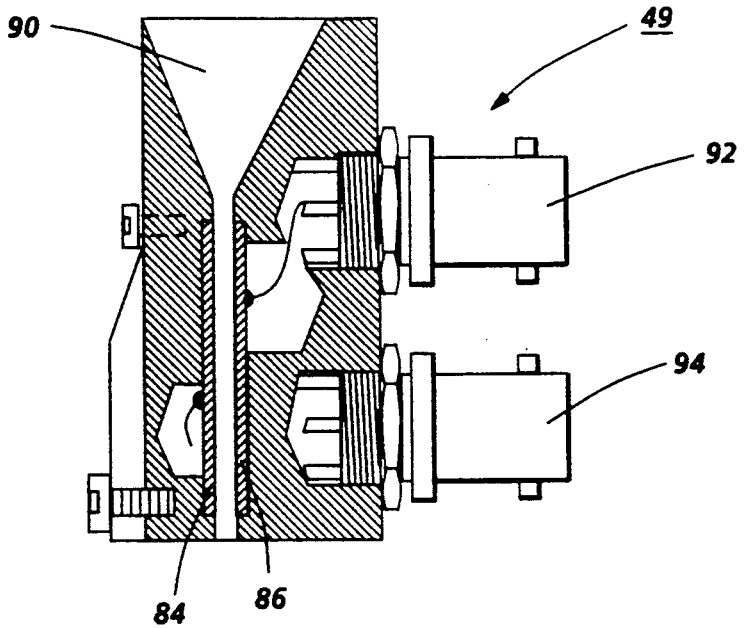
FIG. 3 is a sectional elevational view showing the sensor used in the developer unit of the FIG. 1 printing machine.

Turning to FIG. 3, sensor 49 is shown in greater detail. Sensor 49 is a small capacitance cell which continuously monitors the dielectric properties of the developer material flowing therethrough. Sensor 49 has a pair of parallel, spaced plates 84 and 86 mounted in housing 88. Housing 88 has a funnel shaped entrance 90 for directing the flow of developer material between plates 84 and 86. Connectors 92 and 94 connect plates 84 and 86 to a capacitance bridge. Thus, plates 84 and 86 are electrodes. The change in capacitance detected by sensor 49, as the developer material flows between plates 84 and 86, is a measure of the change in the dielectric properties of the developer material. Variations in the developer material moisture content change the dielectric properties of the developer material. This is shown more clearly in FIG. 4.

Referring now to FIG. 4, sensor 49 responds rapidly to changes in moisture content of the developer material. The capacitance change, as measured by sensor 49, varies from about 12 pf for developer material stored at 20% relative humidity to about 13.5 pf for developer material stored at about 80% relative humidity. When developer material stored at 80% relative humidity overnight is placed in an environment having 20% relative humidity, it takes about 2000 seconds for the capacitance measurement to decay form about 13.5 pf to about 12.5 pf. This change in capacitance is a direct measurement of the change in dielectric properties of the developer material. One skilled in the art will appreciate that changes in impedance of the developer material may be measured in lieu of measuring the change in capacitance. In either case, a direct measurement of the change in the dielectric properties of the developer material is obtained. For example the impedance of the developer material between the developer roll and the trim bar may be measured. Alternatively, an electrode may be positioned against the magnetic brush or an electrode can be embedded in the wall or bottom of the developer housing to monitor developer material impedance between this electrode and a conducting surface. Since the desired signal only has to be a monotonous function of the developer material moisture content, it is not necessary to employ a flat plate configuration for the electrods.

In recapitulation, it is evident that the dielectric characteristics of the developer may be determined by a sensor in direct contact with the developer material. The sensor measures capacitance of the developer material flowing therethrough and transmits a signal indicative thereof. These capacitance changes are caused by the dielectric properties of the developer material changing due to changes in the moisture content thereof. This signal is used in conjunction with other control signals to regulate various processing stations within the printing machine to substantially optimize developability.

It is, therefore, apparent that there has been provided in accordance with the present invention, a humidity compensated control system for use in an electrophotographic printing machine that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An electrophotographic printing machine of the type having a plurality of processing stations with one of the stations being a developer station storing a supply of developer material comprising at least carrier granules and toner particles for developing a latent image recorded on an image receiving member with the toner particles, wherein the improvement includes:

means, in contact with the developer material in the developer station, for measuring the developer material dielectric characteristics and generating a signal indicative thereof which corresponds to changes in the moisture content of the developer material;

means for detecting the concentration of toner particles in the developer material and generating a signal indicative thereof; and means, responsive to the signal from said measuring means and the signal from said detecting means, for controlling discharge of toner particles into the developer station.

2. A printing machine according to claim 1, wherein said measuring means detects the change in the developer material impedance.

3. A printing machine according to claim 1, wherein said measuring means detects the change in the capacitance of the developer material.

4. A printing machine according to claim 3, wherein said measuring means includes a capacitance cell positioned in the developer station so that developer material continuously flows therethrough.

5. A developer unit, including:

means for storing a supply of developer material comprising at least toner particles and carrier granules;

means, positioned in said storing means and contacting the developer material therein, for measuring the developer material dielectric characteristics and generating a signal indicative thereof which corresponds to changes in the moisture content of the developer material;

means for detecting the concentration of toner particles in the developer material and generating a signal indicative thereof; and means, responsive to the signal from said measuring means and the signal from said detecting means, for controlling discharge of toner particles into said storing means.

6. A developer unit according to claim 5, wherein said measuring means senses the change in the developer material impedance.

7. A developer unit according to claim 6, wherein said measuring means senses the change in the developer material capacitance.

8. A developer unit according to claim 7, wherein said measuring means includes a capacitance cell positioned in the developer station so that developer material continuously flows therethrough.

* * * * *